US011651753B2

(12) United States Patent
Jenson

(10) Patent No.: US 11,651,753 B2
(45) Date of Patent: May 16, 2023

(54) PIANO TUNING RETENTION SYSTEM

(71) Applicant: Timothy Jenson, Hemet, CA (US)

(72) Inventor: Timothy Jenson, Hemet, CA (US)

( * ) Notice: Subject to any disclaimer, the term of this patent is extended or adjusted under 35 U.S.C. 154(b) by 0 days.

(21) Appl. No.: 17/807,652

(22) Filed: Jun. 17, 2022

(65) Prior Publication Data

US 2022/0366875 A1 Nov. 17, 2022

Related U.S. Application Data

(63) Continuation of application No. 17/319,992, filed on May 13, 2021, now Pat. No. 11,380,289.

(51) Int. Cl.
*G10C 3/106* (2019.01)
*G10C 3/04* (2006.01)

(52) U.S. Cl.
CPC ..... *G10C 3/106* (2013.01); *G10C 3/04* (2013.01)

(58) Field of Classification Search
CPC ..... G10C 3/106
See application file for complete search history.

(56) References Cited

U.S. PATENT DOCUMENTS 118,354 A * 8/1871 Faas ..... G10C 3/106 84/203
225,017 A * 3/1880 Norcross ..... G10C 3/106 84/203
235,269 A * 12/1880 McBride ..... G10C 3/106 84/203
259,604 A * 6/1882 Thorpe ..... G10C 3/106 84/203
436,163 A 9/1890 Thorpe
745,350 A 12/1903 Hornbeck
982,425 A * 1/1911 Gotterke ..... G10C 3/106 84/203

(Continued)

FOREIGN PATENT DOCUMENTS

CN 1567423 A 1/2005
SU 18597 A1 11/1930

OTHER PUBLICATIONS

Patent Cooperation Treaty, International Search Report and Written Opinion for International Application No. PCT/US22/28738, dated Aug. 17, 2022, 8 pages.

*Primary Examiner* — Robert W Horn
(74) *Attorney, Agent, or Firm* — Stetina Brunda Garred and Brucker

(57) ABSTRACT

A piano tuning retention system includes first and second bushings, each having a threaded upper longitudinal end and a lower longitudinal end that defines a polygonal interior for mating with a polygonal end of a respective piano tuning pin, first and second threaded fasteners corresponding to the threaded upper longitudinal ends of the bushings, first and second sleeves that fit over the bushings, each of the sleeves having an upper longitudinal end with an inward radial extension that defines a reduced inner diameter and a lower longitudinal end that defines a catch (e.g. a notch) extending in a circumferential direction of the sleeve for engagement with a piano string, and a bridge configured to be sandwiched between the threaded fasteners and the inward radial extensions of the sleeves with the bushings disposed within the sleeves and the threaded fasteners fastened to the threaded upper longitudinal ends of the bushings.

18 Claims, 3 Drawing Sheets

(56) References Cited

U.S. PATENT DOCUMENTS

| | | | | | |
|---|---|---|---|---|---|
| 1,094,653 | A * | 4/1914 | Hillcoat | G10C 3/106 | 84/203 |
| 1,298,862 | A * | 4/1919 | Bachman | G10C 3/106 | 84/203 |
| 3,364,804 | A * | 1/1968 | West | G10C 3/106 | 84/202 |
| 3,754,494 | A * | 8/1973 | Ticehurst | G10C 3/106 | 84/203 |
| 11,380,289 | B1 * | 7/2022 | Jenson | G10C 3/106 | |

* cited by examiner

PIANO TUNING RETENTION SYSTEM

CROSS-REFERENCE TO RELATED APPLICATIONS

The present application is a continuation of U.S. patent application Ser. No. 17/319,992, filed May 13, 2021, the entire disclosure of which is expressly incorporated herein by reference.

STATEMENT RE: FEDERALLY SPONSORED RESEARCH/DEVELOPMENT

Not Applicable

BACKGROUND

After the first few years of a piano's life, during which frequent tunings are needed in order to bring the strings to a stable tension, the piano can still go out of tune for various reasons. Most notably in the case of an instrument that is played regularly, the stress placed on the strings by the hammers inevitably causes the tuning pins that hold the strings to turn slightly, lowering the tension on the strings and detuning the instrument. This type of detuning, which can occur in the absence of any degradation of the strings and irrespective of any changes in humidity and temperature, often requires the piano to be tuned two or more times per year at the owner's expense and inconvenience.

Efforts to prevent the movement of piano tuning pins date at least as far back as 1871 as described in U.S. Pat. No. 118,354 to Anthony Joseph Faas ("Faas"). However, such efforts either require the use of uniquely shaped tuning pins as in the case of Faas or involve overly complicated mechanical contraptions, making it impossible or impractical to retrofit an existing piano to keep it from going out of tune.

BRIEF SUMMARY

The present disclosure contemplates various systems and methods for overcoming the above drawbacks accompanying the related art. One aspect of the embodiments of the disclosure is a piano tuning retention system for impeding rotation of a plurality of piano tuning pins of a piano. The system may comprise first and second bushings, each having a threaded upper longitudinal end and a lower longitudinal end that defines a polygonal interior for mating with a polygonal end of a respective one of the piano tuning pins, and first and second threaded fasteners, each having threads corresponding to the threaded upper longitudinal end of a respective one of the bushings. The system may further comprise first and second sleeves, each with an inner diameter greater than an outer diameter of a respective one of the bushings. Each of the sleeves may have an upper longitudinal end with an inward radial extension that defines a reduced inner diameter less than the outer diameter of the respective bushing and a lower longitudinal end that defines a catch extending in a circumferential direction of the sleeve. The system may further comprise a bridge that spans the plurality of piano tuning pins. The bridge may define a first engagement region configured to be sandwiched between the first threaded fastener and the inward radial extension of the first sleeve with the first bushing disposed within the first sleeve and the first threaded fastener fastened to the threaded upper longitudinal end of the first bushing. The bridge may further define a second engagement region configured to be sandwiched between the second threaded fastener and the inward radial extension of the second sleeve with the second bushing disposed within the second sleeve and the second threaded fastener fastened to the threaded upper longitudinal end of the second bushing.

In each of the first and second sleeves, the catch may comprise a notch extending in a circumferential direction of the sleeve that is opposite a rotational direction in which the respective threaded fastener is fastened to the threaded upper longitudinal end of the respective bushing.

The first and second engagement regions of the bridge may be offset from each other to define parallel planes.

The bridge may define one or more openings through which the first and second threaded fasteners are fastened to the threaded upper longitudinal ends of the respective first and second bushings.

The threaded upper end of the first bushing may define a threaded interior of the first bushing, and the first threaded fastener may comprise a bolt.

The piano tuning retention system may comprise first and second washers. Each of the first and second engagement regions of the bridge may be configured to be sandwiched between the respective fastener and the inward radial extension of the respective sleeve with a respective one of the first and second washers disposed between the fastener and the engagement region.

The piano tuning retention system may comprise a third bushing having a threaded upper longitudinal end and a lower longitudinal end that defines a polygonal interior for mating with a polygonal end of a respective one of the piano tuning pins, a third threaded fastener having threads corresponding to the threaded upper longitudinal end of a respective one of the bushings, and a third sleeve with an inner diameter greater than an outer diameter of a respective one of the bushings. The third sleeve may have an upper longitudinal end with an inward radial extension that defines a reduced inner diameter less than the outer diameter of the respective bushing and a lower longitudinal end that defines a catch extending in a circumferential direction of the third sleeve. The bridge may define a third engagement region configured to be sandwiched between the third threaded fastener and the inward radial extension of the third sleeve with the third bushing disposed within the third sleeve and the third threaded fastener fastened to the threaded upper longitudinal end of the third bushing. In each of the first, second, and third sleeves, the catch may comprise a notch extending in a circumferential direction of the sleeve that is opposite a rotational direction in which the respective threaded fastener is fastened to the threaded upper longitudinal end of the respective bushing. The first, second, and third engagement regions of the bridge may be offset from each other to define three parallel planes. The piano tuning retention system may comprise first, second, and third washers. Each of the first, second, and third engagement regions of the bridge may be configured to be sandwiched between the respective fastener and the inward radial extension of the respective sleeve with a respective one of the first, second, and third washers disposed between the fastener and the engagement region.

Another aspect of the embodiments of the disclosure is a method of installing a piano tuning retention system in a piano. The method may comprise fitting a lower longitudinal end of a first bushing onto a polygonal end of a first piano tuning pin of the piano, placing a first sleeve over the first bushing, fitting a lower longitudinal end of a second bushing onto a polygonal end of a second piano tuning pin of the piano, and placing a second sleeve over the second bushing.

The lower longitudinal end of the first bushing may define a polygonal interior for mating with the polygonal end of the first piano tuning pin, and the lower longitudinal end of the second bushing may define a polygonal interior for mating with the polygonal end of the second piano tuning pin. The first sleeve may have an inner diameter greater than an outer diameter of the first bushing and may have an upper longitudinal end with an inward radial extension that defines a reduced inner diameter less than the outer diameter of the first bushing. The second sleeve may have an inner diameter greater than an outer diameter of the second bushing and may have an upper longitudinal end with an inward radial extension that defines a reduced inner diameter less than the outer diameter of the second bushing. The method may further comprise placing a bridge on the upper longitudinal ends of the first and second sleeves and screwing a first threaded fastener to a threaded upper longitudinal end of the first bushing with the bridge and the inward radial extension of the first sleeve therebetween, the direction of screwing causing a circumferentially extending catch defined by a lower longitudinal end of the first sleeve to engage with a piano string held by the first piano tuning pin. The method may further comprise screwing a second threaded fastener to a threaded upper longitudinal end of the second bushing with the bridge and the inward radial extension of the second sleeve therebetween, the direction of screwing causing a circumferentially extending catch defined by a lower longitudinal end of the second sleeve to engage with a piano string held by the second piano tuning pin.

The method may further comprise fitting a lower longitudinal end of a third bushing onto a polygonal end of a third piano tuning pin of the piano and placing a third sleeve over the third bushing. The lower longitudinal end of the third bushing may define a polygonal interior for mating with the polygonal end of the third piano tuning pin. The third sleeve may have an inner diameter greater than an outer diameter of the third bushing and may have an upper longitudinal end with an inward radial extension that defines a reduced inner diameter less than the outer diameter of the third bushing. The placing of the bridge on the upper longitudinal ends of the first and second sleeves may further comprise placing the bridge on the upper longitudinal end of the third sleeve. The method may comprise screwing a third threaded fastener to a threaded upper longitudinal end of the third bushing with the bridge and the inward radial extension of the third sleeve therebetween, the direction of screwing causing a circumferentially extending catch defined by a lower longitudinal end of the third sleeve to engage with a piano string held by the third piano tuning pin.

Another aspect of the embodiments of the disclosure is a piano tuning retention system for impeding rotation of a plurality of piano tuning pins of a piano. The system may comprise a bridge that spans the plurality of piano tuning pins, a first assembly for engagement with a first piano tuning pin of the plurality of piano tuning pins, and a second assembly for engagement with a second piano tuning pin of the plurality of piano tuning pins. The first assembly may include a first bushing fitted on the first piano tuning pin and a first sleeve placed over the first bushing. The first bushing may have a threaded upper longitudinal end and a lower longitudinal end that defines a polygonal interior for mating with a polygonal end of the first piano tuning pin. The first sleeve may have an inner diameter greater than an outer diameter of the first bushing and may have an upper longitudinal end with an inward radial extension that defines a reduced inner diameter less than the outer diameter of the first bushing. The first sleeve may have a lower longitudinal end that defines a catch extending in a circumferential direction of the first sleeve for engagement with a piano string held by the first piano tuning pin. The first assembly may further include a first threaded fastener screwed to the threaded upper longitudinal end of the first bushing with the bridge and the inward radial extension of the first sleeve therebetween. The second assembly may include a second bushing fitted on the second piano tuning pin and a second sleeve placed over the second bushing. The second bushing may have a threaded upper longitudinal end and a lower longitudinal end that defines a polygonal interior for mating with a polygonal end of the second piano tuning pin. The second sleeve may have an inner diameter greater than an outer diameter of the second bushing and may have an upper longitudinal end with an inward radial extension that defines a reduced inner diameter less than the outer diameter of the second bushing. The second sleeve may have a lower longitudinal end that defines a catch extending in a circumferential direction of the second sleeve for engagement with a piano string held by the second piano tuning pin. The second assembly may further include a second threaded fastener screwed to the threaded upper longitudinal end of the second bushing with the bridge and the inward radial extension of the second sleeve therebetween.

In each of the first and second sleeves, the catch may comprise a notch extending in a circumferential direction of the sleeve that is opposite a rotational direction in which the respective threaded fastener is screwed to the threaded upper longitudinal end of the respective bushing.

A portion of the bridge that is between the first threaded fastener and the first bushing may define a first plane that is parallel to and offset from a second plane defined by a portion of the bridge that is between the second threaded fastener and the second bushing.

The first assembly may include a first washer between the first threaded fastener and the bridge, and the second assembly may include a second washer between the second threaded fastener and the bridge.

The piano tuning retention system may comprise a third assembly for engagement with a third piano tuning pin of the plurality of piano tuning pins. The third assembly may include a third bushing fitted on the third piano tuning pin and a third sleeve placed over the third bushing. The third bushing may have a threaded upper longitudinal end and a lower longitudinal end that defines a polygonal interior for mating with a polygonal end of the third piano tuning pin. The third sleeve may have an inner diameter greater than an outer diameter of the third bushing and may have an upper longitudinal end with an inward radial extension that defines a reduced inner diameter less than the outer diameter of the third bushing. The third sleeve may have having a lower longitudinal end that defines a catch extending in a circumferential direction of the third sleeve for engagement with a piano string held by the third piano tuning pin. The third assembly may further include a third threaded fastener screwed to the threaded upper longitudinal end of the third bushing with the bridge and the inward radial extension of the third sleeve therebetween.

The catch of the third sleeve may comprise a notch extending in a circumferential direction of the third sleeve that is opposite a rotational direction in which the third threaded fastener is screwed to the threaded upper longitudinal end of the third bushing.

A portion of the bridge that is between the third threaded fastener and the third bushing may define a third plane that is parallel to and offset from the first and second planes.

The first assembly may include a first washer between the first threaded fastener and the bridge, the second assembly may include a second washer between the second threaded fastener and the bridge, and the third assembly may include a third washer between the third threaded fastener and the bridge.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present disclosure encompasses various embodiments of piano tuning retention systems and methods of installation thereof. The detailed description set forth below in connection with the appended drawings is intended as a description of several currently contemplated embodiments and is not intended to represent the only form in which the disclosed innovations may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
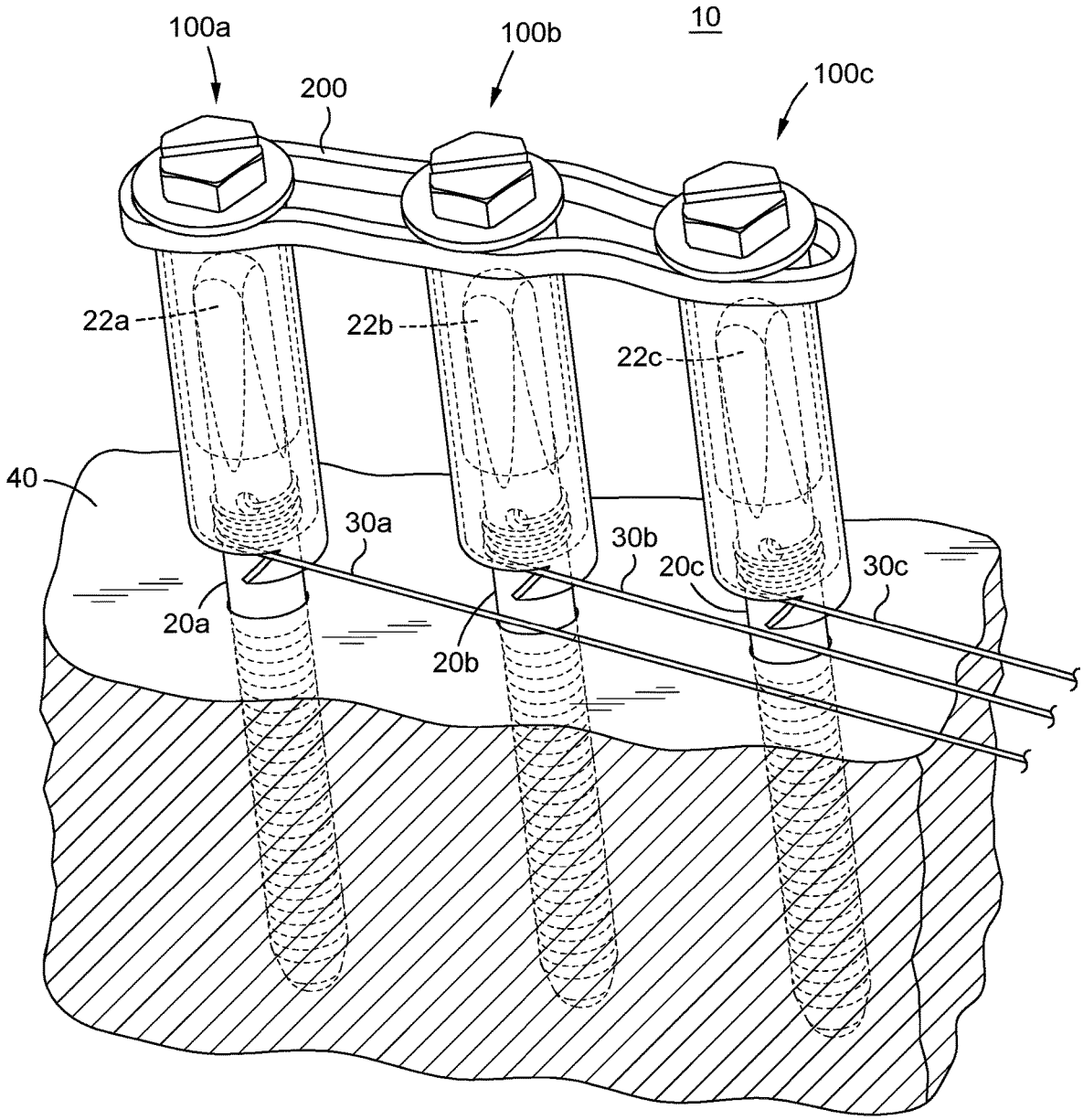
FIG. 1 is a perspective view of a piano tuning retention system according to an embodiment of the present disclosure.

FIG. 1 is a perspective view of a piano tuning retention system 10 according to an embodiment of the present disclosure. The piano tuning retention system 10 may include a plurality of assemblies 100*a*, 100*b*, 100*c* as shown, each of which engages with a respective tuning pin 20*a*, 20*b*, 20*c* from among a plurality of tuning pins driven into a pin bock 40 of a piano. The tuning pins 20*a*, 20*b*, 20*c* may be conventional tuning pins and may be the original tuning pins of the piano, for example. As such, the piano may be retrofitted with the piano tuning retention system 10 without having to replace any tuning pins or the pin block 40 with specialized hardware. The assemblies 100*a*, 100*b*, 100*c* may simply fit over the existing tuning pins 20*a*, 20*b*, 20*c*, fixedly engaging with polygonal ends 22*a*, 22*b*, 22*c* thereof while being held in place by the piano strings 30*a*, 30*b*, 30*c* as described in more detail below. A bridge 200 spanning the plurality of tuning pins 20*a*, 20*b*, 20*c* may engage with each of the assemblies 100*a*, 100*b*, 100*c* to impede rotation of any one of the tuning pins 20*a*, 20*b*, 20*c*. By preventing unwanted rotation of the tuning pins 20*a*, 20*b*, 20*c*, the piano tuning retention system 10 may thus help to keep the piano in tune. When tuning is desired (e.g. due to changes in temperature and humidity), the piano tuning retention system 10 may easily be removed to allow access to the tuning pins 20*a*, 20*b*, 20*c*. After the tuning procedure is complete, the piano tuning retention system 10 may then be reinstalled to maintain the new tuning of the piano.

Figure 2:
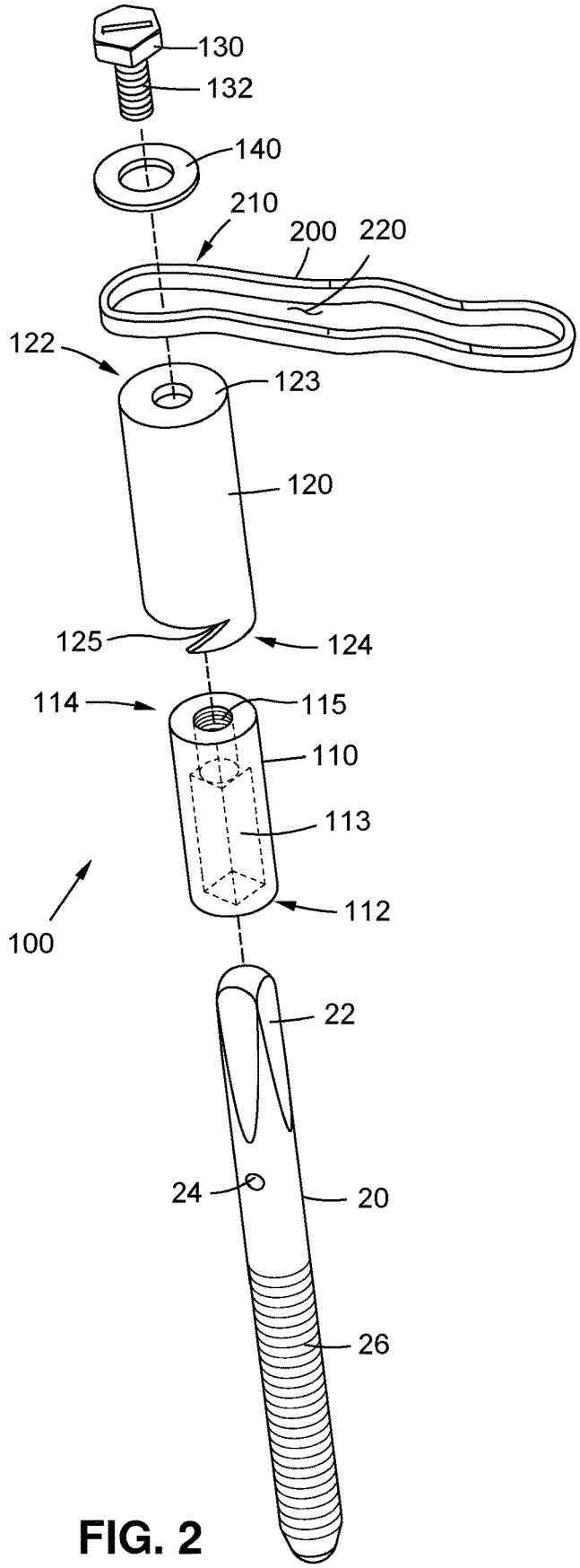
FIG. 2 is an exploded perspective view of a portion of the piano tuning retention system.
Figure 3:
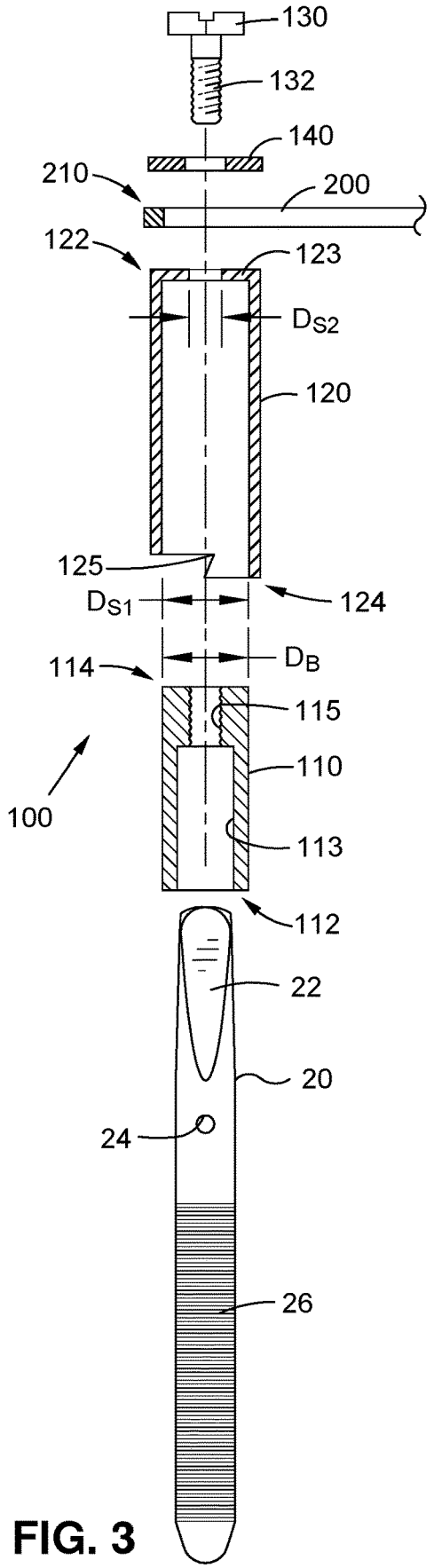
FIG. 3 is an exploded cross-sectional view thereof.

FIG. 2 is an exploded perspective view of a portion of the piano tuning retention system 10, including a single assembly 100 and the bridge 200, together with a single tuning pin 20. FIG. 3 is an exploded cross-sectional view thereof. The assembly 100 shown in FIGS. 2 and 3 may be any of the assemblies 100*a*, 100*b*, 100*c* of FIG. 1, for example, with the associated tuning pin 20 being the corresponding tuning pin 20*a*, 20*b*, 20*c*. As shown, the tuning pin 20 may terminate in an exposed polygonal end 22 having a cross-section that is a square or other polygon. In this regard, the tuning pin 20 may be shaped for engagement with a conventional tuning lever or wrench, for example. Also depicted is a passage 24 for threading of a piano string 30*a*, 30*b*, 30*c* (see FIG. 1), which may typically be wrapped around the tuning pin 20 by the rotation of the tuning pin 20 after being threaded therethrough so as to be securely held at the desired tension. The tuning pin 20 may further include threads 26 for driving the tuning pin 20 into the pin block 40 (see FIG. 1).

The assembly 100 may include a bushing 110 having a lower longitudinal end 112 that defines a polygonal interior 113 for mating with the polygonal end 22 of the piano tuning pin 20. For a tuning pin 20 whose polygonal end 22 has a square cross-section, for example, the polygonal interior 113 defined by the lower longitudinal end 112 of the bushing 110 may be square. In the case of a tuning pin 20 whose polygonal end 22 is tapered, the polygonal interior 113 of the bushing 110 may include a matching taper or may have no taper but simply be wide enough to accommodate the tapered polygonal end 22. Owing to the polygonal interior 113 of the bushing 110, the bushing 110 may be fixedly engaged with the tuning pin 20 so as to rotate together with the rotation of the tuning pin 20. By the same token, the bushing 110 may prevent any rotation of the tuning pin 20 separate from rotation of the bushing 110.

The bushing 110 may further have a threaded upper longitudinal end 114. The threaded upper longitudinal end 114 may have interior threads 115, for example, though exterior threads (i.e. on the outer circumference of the bushing 110) are also contemplated. The assembly 100 may include a threaded fastener 130 (e.g. a bolt) having threads 132 corresponding to the threaded upper longitudinal end 114 of the bushing 110. In the illustrated example, the threaded fastener 130 is a bolt having external threads 132 such that it may be screwed into the threaded upper longitudinal end 114 of the bushing 110. In a case where the threaded upper longitudinal end 114 of the bushing 110 has exterior threads, it is contemplated that the threaded fastener 130 may instead be a cap with interior threads, the cap being configured to fit over the threaded upper longitudinal end 114 of the bushing 110 (which may have a reduced diameter relative to the rest of the bushing 110) and to be screwed thereto.

Before screwing the threaded fastener 130 to the threaded upper longitudinal end 114 of the bushing 110, a sleeve 120 may be placed over the first bushing 110. The sleeve 120 may be used to hold the assembly 100 onto the tuning pin 20 as described in more detail below. In order that it may fit over the bushing 110, the sleeve 120 may have an inner diameter $D_{S1}$ that is greater than an outer diameter $D_B$ of the bushing 110. At the same time, the bushing 110 may be confined to the sleeve 120 by virtue of an inward radial extension 123 of the sleeve 120 at an upper longitudinal end 122 thereof. The inward radial extension 123 may define a reduced diameter $D_{S2}$ that is less than the outer diameter $D_B$ of the bushing 110, while still permitting engagement between the threaded fastener 130 and the upper longitudinal end 114 of the bushing 110. As illustrated, for example, the external threads 132 of the bolt 130 may pass through the upper longitudinal end 122 of the sleeve 120 to engage with the threaded upper longitudinal end 114 of the bushing 110.

In order to hold the assembly 100 onto the tuning pin 20 (which may be particularly important in the case of an upright piano having horizontally oriented tuning pins 20, for example), the sleeve 130 may have a lower longitudinal end 124 that defines a catch such as a protruding lip or a notch 125 extending in a circumferential direction of the sleeve 120. For example, the notch 125 may be a v-shaped cut as shown, beginning from the lower longitudinal end 124 of the sleeve 120 and extending upward at an angle relative to the lower longitudinal end 124 in a direction having a component in the circumferential direction of the sleeve 120. By virtue of extending in the circumferential direction in this way, the notch 125 may be oriented to engage with the corresponding string 30*a*, 30*b*, 30*c* held by the tuning pin 20 (see FIG. 1) as the sleeve 120 is rotated. Once the lip or notch 125 is engaged with the corresponding string 30*a*, 30*b*, 30*c* (referred to generally as string 30), the string 30 serves to hold the sleeve 120 down (i.e. toward the pin block 40) because the lower part of the sleeve 120 protrudes underneath the string 30 by virtue of the shape of the lip or notch 125.

The bridge 200 may be a rigid piece of material such as a loop or sheet of metal or composite material that spans the plurality of tuning pins 20, extending from one assembly 100 to the next (see FIG. 1). As shown in FIGS. 2 and 3, the bridge 200 may define an engagement region 210 configured to be sandwiched between the threaded fastener 130 and the inward radial extension 123 of the sleeve 120. In particular, the engagement region 210 of the bridge 200 may be sandwiched between the threaded fastener 130 and the inward radial extension 123 of the sleeve 120 with the bushing 110 disposed within the sleeve 120 and the threaded fastener 130 fastened to the threaded upper longitudinal end 114 of the bushing 110. In this way, the bridge 200 may be fixed to the assembly 100, which may be held onto the tuning pin 20 by the engagement of the lip or notch 125 with the string 30. One or more washers 140, such as a lock washer, a flat washer, or both, may be disposed between the threaded fastener 130 and the engagement region 210 of the bridge 200 in order to provide a surface for distributing the load of the threaded fastener 130 and/or to help prevent loosening of the threaded fastener 130. As described in more detail in relation to FIG. 4, below, the bridge 200 may have other engagement regions 210 that are likewise fixed to other assemblies 100, with the rigidity of the bridge 200 thus preventing rotation of any of the assemblies 100 (and consequently preventing rotation of any of the tuning pins 20).

The bridge may define one or more openings 220 through which the threaded fasteners 130 are fastened to the threaded upper longitudinal ends 114 of the respective bushings 110. For example, if the bridge 200 is shaped as a loop as shown, the interior of the loop may define a single opening 220 and each engagement region 210 may consist of two opposing sides of the loop as in the case of the assembly 100*b* (see FIG. 1) or an end of the loop as in the case of the assembly 100*a*. If the bridge 200 is a sheet of metal rather than a loop, each engagement region 200 may be a region of the sheet in which a respective opening is formed through which the threaded fastener 130 can engage with the threaded upper longitudinal end 114 of the bushing 110. As another possibility, the bridge 200 may simply be a rigid length of metal or other material that passes only one side of each threaded fastener 130 as it spans the plurality of assemblies 100, like the illustrated loop-shaped bridge 200 but consisting of only a single side of the loop. In this case, there may be no openings, and the engagement regions 210 may simply be segments of the length of material constituting the bridge 200.

Figure 4:
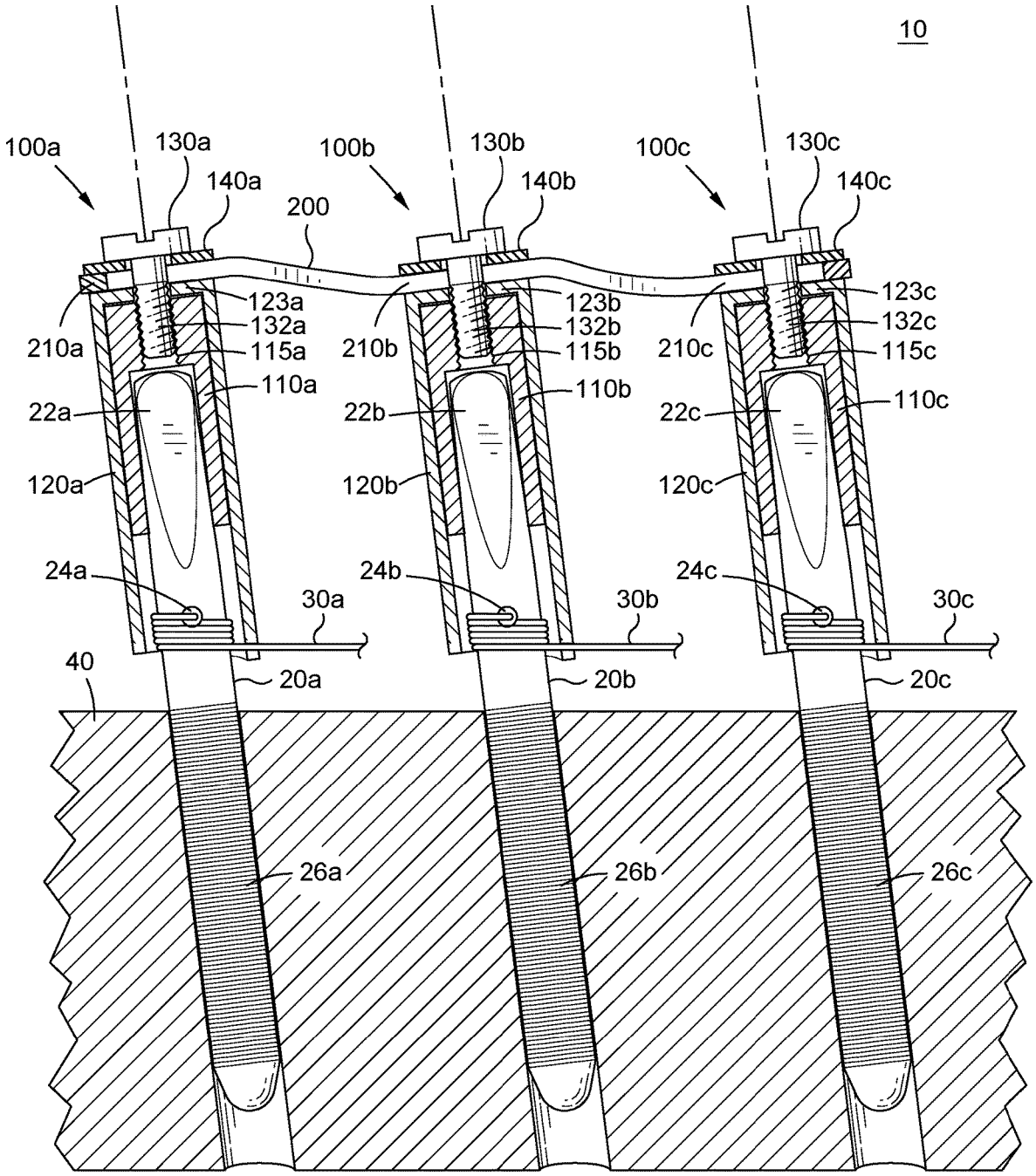
FIG. 4 is a cross-sectional view of the piano tuning retention system.

FIG. 4 is a cross-sectional view of the piano tuning retention system 10. As shown, each of the engagement regions 210 (e.g. 210*a*, 210*b*, 210*c*) of the bridge 200 may be a region of the bridge 200 that has a straight profile in order to allow the bridge 200 to be easily sandwiched between the threaded fasteners 130 and the sleeves 120. The same may be true regardless of the form of the engagement regions 210, whether the bridge 200 is a loop or some other shape. Between the engagement regions 210, the bridge 200 may be angled, such that the straight engagement regions 210 may be offset from each other to define parallel planes, forming a series of steps along the length of the bridge 200. In this way, the bridge 200 may accommodate assemblies 100 installed on a series of tuning pins 20 that are driven into the pin block 40 at an angle. A piano may have angled tuning pins 20 in order to better maintain tension on the strings 30, for example. It is contemplated that the same piano tuning system 10 may be used on many different pianos and may include a variety of different bridges 200 for compatibility with differently angled tuning pins 20. Alternatively, a single bridge 200 may be provided with adjustable (e.g. hinged) segments between each engagement region 210.

To install the piano tuning retention system 10 in a piano, a person may first fit the lower longitudinal end 112 of a first bushing 110 onto the polygonal end 22 of a first tuning pin 20. As noted above, the lower longitudinal end 112 of the bushing 110 may define a polygonal interior 113 for mating with the polygonal end 22 of the tuning pin 20 to prevent separate movement thereof. The person may then place a first sleeve 120 over the first bushing 110. The person may similarly place bushings 110 and sleeves 120 on one or more additional tuning pins 20. Once the bushings 110 and sleeves 120 are on each of the tuning pins 20 that are to be connected together by the piano tuning retention system 10 (typically two or three tuning pins 20), the person may place the bridge 200 on the upper longitudinal ends 123 of the sleeves 120. The bridge 200 may be placed on the sleeves 120 so that the engagement regions 210 of the bridge 200 align with the upper longitudinal ends 123 of the sleeves 120. Lastly, the person may screw a threaded fastener 130 (along with possibly one or more washers 140) to the threaded upper longitudinal end 114 of each bushing 110 with the bridge 200 and the inward radial extension 123 of the corresponding sleeve 120 therebetween. Engagement between the threaded fastener 130 and the threaded upper longitudinal end 114 may be via an opening 220 in the engagement region 210 of the bridge 200, for example.

As the person screws each threaded fastener 130 to the threaded upper longitudinal end 114 of the respective bushing 110, the direction of tightening may cause a circumferentially extending notch 125 (see FIGS. 1-3) defined in the lower longitudinal end 124 of the corresponding sleeve 120 to engage with the piano string 30 held by the corresponding tuning pin 20. In this regard, the notch 125 may extend in a circumferential direction of the sleeve 120 that is opposite a rotational direction in which the threaded fastener 130 is fastened to the threaded upper longitudinal end 114 of the bushing 110. For example, for a clockwise tightening threaded fastener 130, the notch 125 may be cut into the sleeve 120 in a counterclockwise direction (e.g. with the point of a v-shaped notch 125 pointing in a direction having a counterclockwise circumferential component), such that the notch 125 "catches" the string 30 as the sleeve 120 is rotated clockwise. If a protruding lip, rather than the notch 125, is used as the catch, the lip may protrude in the clockwise direction for substantially the same effect. Thereafter, as the person continues to tighten the threaded fastener 130 to the bushing 110, the relative movement of the threads 132, 115 causes the bushing 110 to move upward toward the threaded fastener 130 and abut the inward radial extension 123 of the sleeve 120 from within, pressing the inward radial extension 123 upward against the bridge 200 (see, e.g., threads 132*a*, 115*a* and inward radial extension 123*a* in FIG. 4). In this way, the bridge 200 may be sandwiched between the threaded fastener 130 and the inward radial extension 123 of the sleeve 120 by the tightening of the threaded fastener 130, while at the same time the sleeve 120 may keep the entire assembly 100 on the tuning pin 20 by virtue of the string 30 being caught by the lip or notch 125 (see FIGS. 1 and 2).

To remove the piano tuning retention system 10, the person may simply unscrew the threaded fasteners 130, after which the threaded fasteners 130, washers 140, and bridge 200 can be removed. Once the threaded fasteners 130 are loosened, the inward radial extension 123 of the sleeve 120 is no longer sandwiched tightly between the bushing 110 and the bridge 200, allowing the sleeve 120 to rotate freely. A slight counterclockwise rotation of the sleeve 120 will free the string 30 from the catch (lip or notch 125), allowing the sleeve 120 to be removed, after which the bushing 110 is free to be removed as well.

In the illustrated example of the piano tuning retention system 10, three assemblies 100 are placed respectively on three tuning pins 20 and are connected by a single bridge 200. The three strings 30 held by these tuning pins 20 may, for example, be the three strings corresponding to a single key in the upper register of a piano (i.e. the three strings that are simultaneously struck by the same hammer when the key is played). In the case of the middle register of the piano, where there are only two strings 30 corresponding to each key, the piano tuning retention system 10 may be employed with only two assemblies 100, one for each of the two tuning pins 20. The construction of the bridge 200 may be the same in this case, but with only two out of the three engagement regions 210 being used and the third left unused, or alternatively a bridge 200 with only two engagement regions 210 may be used. As another example, whether in the case of connecting two assemblies 100, three assemblies 100, or more, the connected assemblies 100 may be placed on tuning pins 20 corresponding to different keys of the piano, rather than the same key. For example, the bridge 200 may span two or more tuning pins 20 corresponding to consecutive (or non-consecutive) keys on the piano. This may be the only possibility in the lower register of the piano, where there is only a single string 30 corresponding to each key. For example, a first row of one or more piano tuning retention systems 10 may extend from the lowest string 30 of the piano to the highest, connecting the tuning pins 20 of the lower register keys, a first set of tuning pins 20 of the middle register keys, and a first set of tuning pins 20 of the upper register keys. Parallel to the first row, a second row of one or more piano tuning retention systems 10 may begin at the middle register and connect the remainder of the tuning pins 20 of the middle register keys and a second set of tuning pins 20 of the upper register keys. Lastly, parallel to the first and second rows, a third row of one or more piano tuning retention systems 10 may begin at the upper register and connect the remainder of the tuning pins 20 of the upper register keys. In each such row, it is contemplated that any number of adjacent tuning pins 20 may be connected by the same bridge 200.

Depending on the particular piano and the desired installation, the above-described angling of the bridge 200 between the engagement regions 210 may be unneeded. For example, in the case of assemblies 100 that are placed on tuning pins 20 corresponding to different keys of the piano (e.g. connecting a series of tuning pins 20 in the lower register of the piano), the bridge 200 may be flat (i.e. without any angle or contour producing steps along its length) since the tuning pins 20 may all be aligned height-wise. The bridge 200 may still of course be installed at an angle relative to the pin block 40 to accommodate any angle at which the tuning pins 20 are driven into the pin block 40. In general, the shape, size and contouring of the bridge 200 may be designed to conform to the number of pins 20 in a retention grouping and the orientation of the pins 20 in that grouping. For instance, the system 10 may provide an installer or tuner with the flexibility to use any of the following bridge configurations: 1) flat on the x-y plane, parallel sides, oval ends, non-bent on the x-y plane, 2) flat on the x-y plane, parallel sides, oval ends, bent to any angle on the x-y plane, 3) contoured relative to the x-y plane, parallel sides, oval ends, non-bent on the x-y plane, 4) contoured relative to the x-y plane, parallel sides, oval ends, bent to any angle on the x-y plane, or others. In theory, by overlapping and piggy-backing a combination of flat, uncontoured bridges and contoured bridges, either bent or non-bent, a tuner or installer could stabilize any grouping of pins 20 using virtually an unlimited number of configurations. In addition to being flat or contoured/angled, bridges 200 can have different shapes and can be fabricated from hollowed out oval parallels for easier and more universal installation or made from blanks of various metals, materials or composites that are shaped, contoured and drilled with precision holes for precision installation to accommodate any specific orientation and arrangement of pins 20.

As noted above, the bridge 200 may be a rigid piece of material such as a loop or sheet of metal or composite material. The other components of the piano tuning retention system 10, including the bushing 110 and sleeve 120 of each assembly 100, for example, may likewise be made of metal, such as brass or stainless steel, or a composite material. It is contemplated, however, that other materials such as felt, silicone, and/or rubber, which may have less rigidity, could be incorporated at various positions in the assembly 100 in order to mitigate sound from unwanted vibrations or scratching of the piano metal or paint. For example, a damper bushing may be incorporated at the bottom of the bushing 110 or sleeve 120 at the position of the notch 125 (or on the lip) in order to prevent vibration of brass or other metal against the piano string 30.

Throughout the above description, when the terms upper, lower, upward, down, etc. are used in relation to directions in the drawings, it should be borne in mind that the pin block 40 is not necessarily oriented horizontally with the tuning pins 20 protruding upward counter to the direction of gravity. For example, in the case of an upright piano, the pin block 40 may be oriented vertically with the tuning pins 20 protruding sideways relative to the direction of gravity. Therefore, in the context of describing the components of the piano tuning retention system 10, such directional terms are used to describe directions relative to the pin block 40, with upper and upward referring to a direction away from the pin block 40 and lower and down referring to a direction toward the pin block 40. In other contexts, the terms may of course have other meanings as will be apparent to a person having ordinary skill in the art (e.g. upper and lower register referring to pitch frequency).

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A piano tuning retention system for impeding rotation of a plurality of piano tuning pins of a piano, the system comprising:

first and second bushings, each having an upper longitudinal end and a lower longitudinal end that defines a polygonal interior for mating with a polygonal end of a respective one of the piano tuning pins;

first and second fasteners, each corresponding to the upper longitudinal end of a respective one of the bushings;

first and second sleeves, each with an inner diameter greater than an outer diameter of a respective one of the bushings, each of the sleeves having an upper longitudinal end with an inward radial extension that defines a reduced inner diameter less than the outer diameter of the respective bushing and a lower longitudinal end that defines a catch extending in a circumferential direction of the sleeve; and a bridge that spans the plurality of piano tuning pins, the bridge defining a first engagement region configured to be positioned between the first fastener and the inward radial extension of the first sleeve with the first bushing disposed within the first sleeve and the first fastener fastened to the upper longitudinal end of the first bushing, the bridge further defining a second engagement region configured to be positioned between the second fastener and the inward radial extension of the second sleeve with the second bushing disposed within the second sleeve and the second fastener fastened to the upper longitudinal end of the second bushing.

2. The piano tuning retention system of claim 1, wherein, in each of the first and second sleeves, the catch comprises a notch extending in a circumferential direction of the sleeve that is opposite a rotational direction in which the respective fastener is fastened to the upper longitudinal end of the respective bushing.

3. The piano tuning retention system of claim 1, wherein the first and second engagement regions of the bridge are offset from each other to define parallel planes.

4. The piano tuning retention system of claim 1, wherein the bridge defines one or more openings through which the first and second fasteners are fastened to the upper longitudinal ends of the respective first and second bushings.

5. The piano tuning retention system of claim 1, wherein the upper end of the first bushing defines an interior of the first bushing, and the first fastener comprises a bolt.

6. The piano tuning retention system of claim 1, further comprising first and second washers, wherein each of the first and second engagement regions of the bridge is configured to be positioned between the respective fastener and the inward radial extension of the respective sleeve with a respective one of the first and second washers disposed between the fastener and the engagement region.

7. The piano tuning retention system of claim 1, further comprising:

a third bushing having an upper longitudinal end and a lower longitudinal end that defines a polygonal interior for mating with a polygonal end of a respective one of the piano tuning pins;

a third fastener corresponding to the upper longitudinal end of a respective one of the bushings; and a third sleeve with an inner diameter greater than an outer diameter of a respective one of the bushings and having an upper longitudinal end with an inward radial extension that defines a reduced inner diameter less than the outer diameter of the respective bushing and a lower longitudinal end that defines a catch extending in a circumferential direction of the third sleeve, wherein the bridge further defines a third engagement region configured to be positioned between the third fastener and the inward radial extension of the third sleeve with the third bushing disposed within the third sleeve and the third fastener fastened to the upper longitudinal end of the third bushing.

8. The piano tuning retention system of claim 7, wherein, in each of the first, second, and third sleeves, the catch comprises a notch extending in a circumferential direction of the sleeve that is opposite a rotational direction in which the respective fastener is fastened to the upper longitudinal end of the respective bushing.

9. The piano tuning retention system of claim 7, wherein the first, second, and third engagement regions of the bridge are offset from each other to define three parallel planes.

10. The piano tuning retention system of claim 7, further comprising first, second, and third washers, wherein each of the first, second, and third engagement regions of the bridge is configured to be positioned between the respective fastener and the inward radial extension of the respective sleeve with a respective one of the first, second, and third washers disposed between the fastener and the engagement region.

11. A method of installing a piano tuning retention system in a piano, the method comprising:

fitting a lower longitudinal end of a first bushing onto a polygonal end of a first piano tuning pin of the piano, the lower longitudinal end defining a polygonal interior for mating with the polygonal end of the first piano tuning pin;

placing a first sleeve over the first bushing, the first sleeve having an inner diameter greater than an outer diameter of the first bushing and having an upper longitudinal end with an inward radial extension that defines a reduced inner diameter less than the outer diameter of the first bushing;

fitting a lower longitudinal end of a second bushing onto a polygonal end of a second piano tuning pin of the piano, the lower longitudinal end defining a polygonal interior for mating with the polygonal end of the second piano tuning pin;

placing a second sleeve over the second bushing, the second sleeve having an inner diameter greater than an outer diameter of the second bushing and having an upper longitudinal end with an inward radial extension that defines a reduced inner diameter less than the outer diameter of the second bushing;

placing a bridge on the upper longitudinal ends of the first and second sleeves;

connecting a first fastener to an upper longitudinal end of the first bushing with the bridge and the inward radial extension of the first sleeve therebetween, causing a circumferentially extending catch defined by a lower longitudinal end of the first sleeve to engage with a piano string held by the first piano tuning pin; and connecting a second fastener to an upper longitudinal end of the second bushing with the bridge and the inward radial extension of the second sleeve therebetween, causing a circumferentially extending catch defined by a lower longitudinal end of the second sleeve to engage with a piano string held by the second piano tuning pin.

12. The method of claim 11, further comprising:

fitting a lower longitudinal end of a third bushing onto a polygonal end of a third piano tuning pin of the piano, the lower longitudinal end defining a polygonal interior for mating with the polygonal end of the third piano tuning pin;

placing a third sleeve over the third bushing, the third sleeve having an inner diameter greater than an outer diameter of the third bushing and having an upper longitudinal end with an inward radial extension that defines a reduced inner diameter less than the outer diameter of the third bushing, wherein said placing the bridge on the upper longitudinal ends of the first and second sleeves further comprises placing the bridge on the upper longitudinal end of the third sleeve; and connecting a third fastener to an upper longitudinal end of the third bushing with the bridge and the inward radial extension of the third sleeve therebetween, causing a circumferentially extending catch defined by a lower longitudinal end of the third sleeve to engage with a piano string held by the third piano tuning pin.

13. A piano tuning retention system for impeding rotation of a plurality of piano tuning pins of a piano, the system comprising:

a bridge that spans the plurality of piano tuning pins;

a first assembly for engagement with a first piano tuning pin of the plurality of piano tuning pins, the first assembly including:

a first bushing fitted on the first piano tuning pin, the first bushing having an upper longitudinal end and a lower longitudinal end that defines a polygonal interior for mating with a polygonal end of the first piano tuning pin;

a first sleeve placed over the first bushing, the first sleeve having an inner diameter greater than an outer diameter of the first bushing and having an upper longitudinal end with an inward radial extension that defines a reduced inner diameter less than the outer diameter of the first bushing, the first sleeve further having a lower longitudinal end that defines a catch extending in a circumferential direction of the first sleeve for engagement with a piano string held by the first piano tuning pin; and a first fastener attached to the upper longitudinal end of the first bushing with the bridge and the inward radial extension of the first sleeve therebetween; and a second assembly for engagement with a second piano tuning pin of the plurality of piano tuning pins, the second assembly including:

a second bushing fitted on the second piano tuning pin, the second bushing having an upper longitudinal end and a lower longitudinal end that defines a polygonal interior for mating with a polygonal end of the second piano tuning pin;

a second sleeve placed over the second bushing, the second sleeve having an inner diameter greater than an outer diameter of the second bushing and having an upper longitudinal end with an inward radial extension that defines a reduced inner diameter less than the outer diameter of the second bushing, the second sleeve further having a lower longitudinal end that defines a catch extending in a circumferential direction of the second sleeve for engagement with a piano string held by the second piano tuning pin; and a second fastener attached to the upper longitudinal end of the second bushing with the bridge and the inward radial extension of the second sleeve therebetween.

14. The piano tuning retention system of claim 13, wherein a portion of the bridge that is between the first fastener and the first bushing defines a first plane that is parallel to and offset from a second plane defined by a portion of the bridge that is between the second fastener and the second bushing.

15. The piano tuning retention system of claim 13, wherein the first assembly further includes a first washer between the first fastener and the bridge, and the second assembly further includes a second washer between the second fastener and the bridge.

16. The piano tuning retention system of claim 13, further comprising a third assembly for engagement with a third piano tuning pin of the plurality of piano tuning pins, the third assembly including:

a third bushing fitted on the third piano tuning pin, the third bushing having an upper longitudinal end and a lower longitudinal end that defines a polygonal interior for mating with a polygonal end of the third piano tuning pin;

a third sleeve placed over the third bushing, the third sleeve having an inner diameter greater than an outer diameter of the third bushing and having an upper longitudinal end with an inward radial extension that defines a reduced inner diameter less than the outer diameter of the third bushing, the third sleeve further having a lower longitudinal end that defines a catch extending in a circumferential direction of the third sleeve for engagement with a piano string held by the third piano tuning pin; and a third fastener attached to the upper longitudinal end of the third bushing with the bridge and the inward radial extension of the third sleeve therebetween.

17. The piano tuning retention system of claim 16, wherein a portion of the bridge that is between the third fastener and the third bushing defines a third plane that is parallel to and offset from the first and second planes.

18. The piano tuning retention system of claim 16, wherein the first assembly further includes a first washer between the first fastener and the bridge, the second assembly further includes a second washer between the second fastener and the bridge, and the third assembly further includes a third washer between the third fastener and the bridge.

* * * * *